US008443562B2

(12) United States Patent
Paul et al.

(10) Patent No.: US 8,443,562 B2
(45) Date of Patent: May 21, 2013

(54) FORM FOR A CONCRETE FOOTING

(76) Inventors: David C. Paul, Frederick, MD (US); Alan D. Weiner, Rockville, MD (US)

( * ) Notice: Subject to any disclaimer, the term of this patent is extended or adjusted under 35 U.S.C. 154(b) by 46 days.

(21) Appl. No.: 12/936,397

(22) PCT Filed: Mar. 17, 2009

(86) PCT No.: PCT/US2009/001663

§ 371 (c)(1),
(2), (4) Date: Oct. 4, 2010

(87) PCT Pub. No.: WO2009/134301

PCT Pub. Date: Nov. 5, 2009

(65) Prior Publication Data

US 2011/0030298 A1 Feb. 10, 2011

Related U.S. Application Data

(60) Provisional application No. 61/071,497, filed on May 1, 2008, provisional application No. 61/202,002, filed on Jan. 16, 2009.

(51) Int. Cl.

| | |
|---|---|
| ***E02D 27/32*** | (2006.01) |
| ***E02D 27/46*** | (2006.01) |
| ***E04G 15/04*** | (2006.01) |

(52) U.S. Cl.

USPC ..... 52/295; 249/190; 249/188; 249/34; 249/187.1; 52/296; 52/297; 52/294

(58) Field of Classification Search

USPC ..... 52/169.1–169.14, 292–299, 155, 52/425–442, 561–568, 698–715; 249/97, 249/33–48, 13–21, 117, 122, 138, 141, 143, 249/147, 168, 187.1, 188–195

See application file for complete search history.

(56) References Cited

U.S. PATENT DOCUMENTS

| | | | | |
|---|---|---|---|---|
| 1,447,942 | A | 3/1923 | Fitzgerald | |
| 1,958,889 | A * | 5/1934 | Fish | 52/297 |
| 3,461,639 | A * | 8/1969 | Merrill | 52/742.14 |
| 4,106,743 | A * | 8/1978 | Dendinger | 249/34 |
| 4,594,899 | A | 6/1986 | Henke et al. | |
| 4,767,241 | A * | 8/1988 | Wells | 405/239 |
| 5,392,580 | A | 2/1995 | Baumann | |
| 5,868,180 | A * | 2/1999 | Hendrickson | 141/331 |
| 6,973,822 | B1 | 12/2005 | Sawyers | |
| 7,076,925 | B2 * | 7/2006 | Gagliano | 52/155 |
| RE39,468 | E | 1/2007 | Ricker | |
| 2004/0020145 | A1 | 2/2004 | Matsufuji | |

FOREIGN PATENT DOCUMENTS

| | | |
|---|---|---|
| JP | 06-155431 | 6/1994 |
| JP | 09-158210 | 6/1997 |
| KR | 20-0424776 | 8/2006 |
| WO | WO 88/03590 | 5/1988 |

* cited by examiner

*Primary Examiner* — Jeanette E. Chapman
(74) *Attorney, Agent, or Firm* — Richard C. Litman

(57) ABSTRACT

The form for a concrete footing (10) is a mold for receiving concrete for footings on construction projects. The form has a housing (12), and a plurality of horizontal support members (16) that extend across the hollow interior of the housing. The form may be manufactured from plastic, cardboard, concrete or other materials. Vertical tubes (14) extend from the top and bottom and are hollow to allow for in situ soil sampling after the footing has been set in the excavation.

16 Claims, 14 Drawing Sheets

FORM FOR A CONCRETE FOOTING

CROSS-REFERENCE TO RELATED APPLICATION

This application is a 371 of PCT/US09/01663, filed Mar. 17, 2009, which claims the benefit of U.S. Provisional Patent Application Ser. No. 61/071,497, filed May 1, 2009 and U.S. Provisional Patent Application Ser. No. 61/202,002, filed Jan. 16, 2009.

TECHNICAL FIELD

The present invention relates to concrete construction, and more particularly, to a form for a concrete footing that permits on-site soil testing after the footing has been poured.

BACKGROUND ART

Foundations are one of the most important aspects of construction. The foundation is the part of the structure which interacts with the earth, and when properly constructed, allows construction of buildings that will withstand the powerful forces of nature, such as gravity, soil swelling, frost heaving and hydrostatic pressure.

Footings are the structural members that transmit the concentrated loads of the structure to the soil. These members are formed in various shapes and sizes and are generally constructed of steel-reinforced concrete. The footings are usually a minimum of two to three times wider than the width of the foundation wall. The thickness of the footing is a function of the weight of the structure above and the strength of the soil below the footing. A thicker footing will be stronger than a thinner footing. The footing is usually installed immediately after excavation. The foundation is then constructed on top of the footing. Generally, the footing is constructed independently of the foundation, and is normally constructed from reinforced concrete cast directly into an excavation formed in the soil to penetrate through the zone of frost movement and/or to obtain additional bearing capacity. Foundations are also structural members, transmitting loads from buildings and other structures to the earth. Foundations are designed based on the load characteristics of the structure and the properties of the soils and/or bedrock at the site.

In general, the primary considerations for foundation support are bearing capacity, settlement, and ground movement beneath the foundations. Bearing capacity is the ability of the site soils to support the loads imposed by buildings or structures. Settlement occurs under all foundations in all soil conditions, although lightly loaded structures or rock sites may experience negligible settlements. For heavier structures or softer sites, both overall settlement relative to unimproved areas or neighboring buildings and differential settlement under a single structure can be a matter of concern. Of particular interest is settlement that occurs over time, as immediate settlement can usually be compensated for during construction. Ground movement beneath a structure's foundations can occur due to shrinkage or swelling of expansive soils due to climactic changes, frost expansion of soil, melting of permafrost, slope instability or other causes.

Many building codes specify basic foundation design parameters for simple conditions, frequently varying by jurisdiction, but such design techniques are normally limited to certain types of construction and certain types of sites, and are frequently very conservative. In areas of shallow bedrock, most foundations may bear directly on bedrock. In other areas, the soil may provide sufficient strength for the support of structures. In areas of deeper bedrock with soft overlying soils, deep foundations are used to support structures directly on the bedrock. In areas where bedrock is not economically available, stiff "bearing layers" are used to support deep foundations instead.

Generally, a construction project begins with a site investigation of soil and bedrock on and below an area of interest to determine their engineering properties including how they will interact with, on or in a proposed construction. Site investigations are needed to gain an understanding of the area in or on which the construction will take place.

The engineering properties of soils are affected by four main factors: the predominant size of the mineral particles; the type of mineral particles; the grain size distribution; and the relative quantities of mineral, water and air present in the soil matrix. To obtain information about the soil conditions below the surface, some form of subsurface exploration, such as obtaining a sample of the underlying soil, is required.

Soil samples are obtained in either "disturbed" or "undisturbed" condition. A disturbed sample is one in which the structure of the soil has been changed sufficiently that tests of structural properties of the soil will not be representative of in situ conditions, and only properties of the soil grains can be accurately determined. An undisturbed sample is one where the condition of the soil in the sample is close enough to the conditions of the soil in situ to allow tests of structural properties of the soil to be used to approximate the properties of the soil in situ.

Soil samples may be gathered using a variety of samplers. Some provide only disturbed samples, while others can provide relatively undisturbed samples. Samples can be obtained by methods as simple as digging out soil from the site using a shovel. Samples taken this way are disturbed samples. More sophisticated sampling methods can be used to obtain undisturbed samples.

During construction projects, it often becomes important, or may even be required, to monitor in situ conditions of the subsoil while the project is ongoing. Obtaining undisturbed representative samples can be difficult, if not impossible, in areas where concrete footings have already been set in place. There is a need, therefore, for a concrete footing system that will permit in situ sampling and encapsulate the metal reinforcement structure therein to protect it from corrosion. Thus, a form for a concrete footing solving the aforementioned problems is desired.

DISCLOSURE OF INVENTION

The form for a concrete footing is a pre-cast mold for receiving concrete to form footings for construction projects. A housing that may be formed from plastic, cardboard, or concrete has a lateral framework of horizontal support members extending across opposing walls of the housing. A plurality of vertical tubular members may be welded or otherwise attached to the horizontal support members. The vertical tubes are hollow, providing access to the subsoil beneath the footing for in situ soil sampling. The mold may be manufactured in various configurations, depending on the nature of the excavation, the type of structure being constructed and the requirements of local building codes. The form is placed directly into the excavation, the concrete is poured into the form, and the form is left in place to become an integral part of the footing as the concrete sets.

The form may include a plurality of internal bosses or anchors, into which the ends of the rebar may be secured at the time of assembly. In addition, the housing may be omitted, so that the concrete footing may be formed by supporting a grid or lattice of horizontal support members across the walls of the excavation, with the vertical tubes being attached to the horizontal support members in such a manner that the vertical tubes form a passage from top to bottom of the footing when the concrete is poured into the excavation and set to form the footing.

These and other features of the present invention will become readily apparent upon further review of the following specification and drawings.

BRIEF DESCRIPTION OF THE DRAWINGS

Similar reference characters denote corresponding features consistently throughout the attached drawings.

BEST MODES FOR CARRYING OUT THE INVENTION

The present invention relates to various embodiments of a form for a concrete footing. Each of the forms has a grid of reinforcement bars ("rebar") installed therein, along with at least one soil sampling tube or pipe attached to the rebar grid, the soil sampling tube preferably having a length adapted for extending above and below the footing. The footing is shipped or transported to the field for installation in an appropriate excavation for filling with concrete to form the desired footing.

Figure 1:
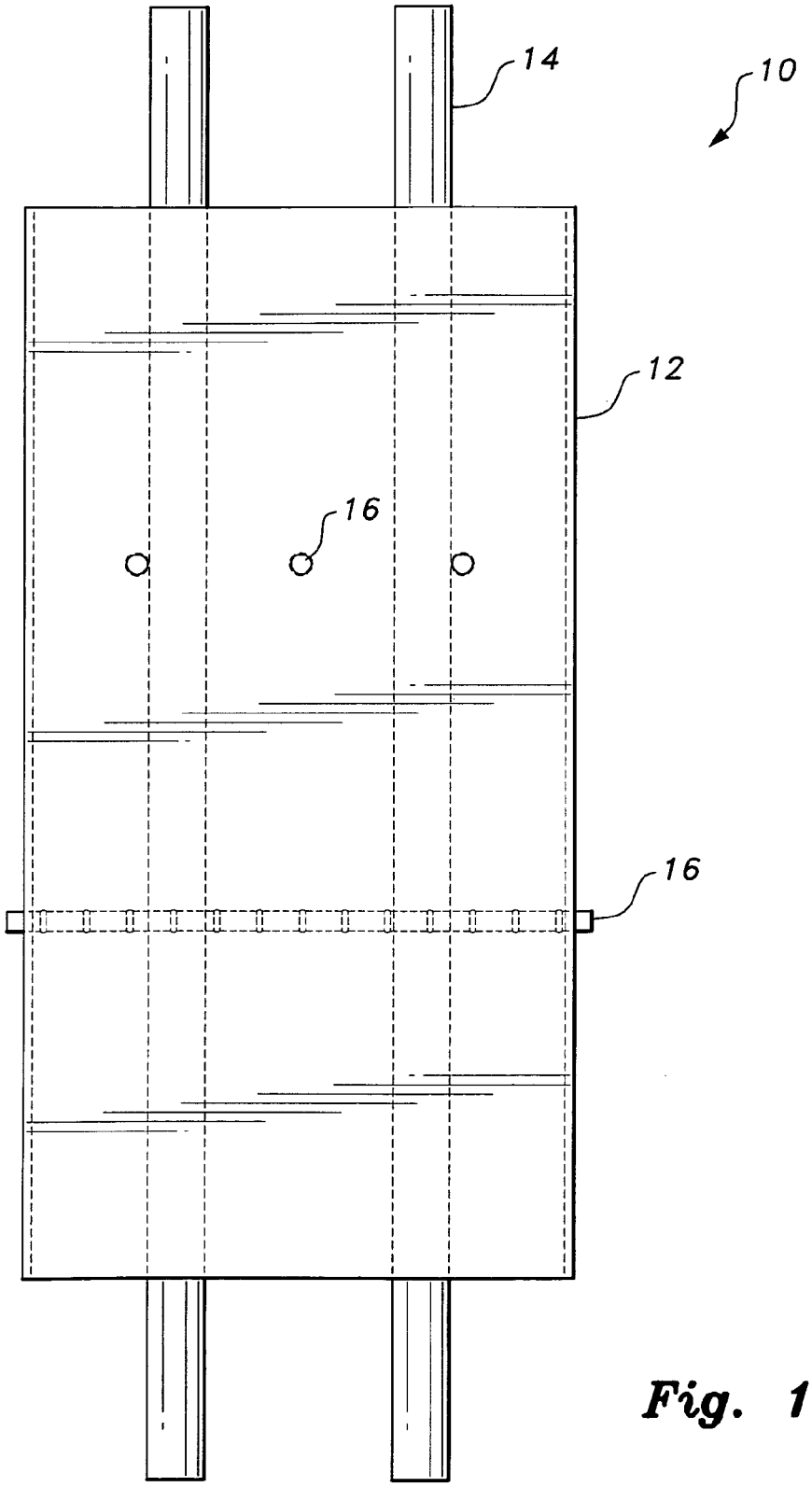
FIG. 1 is a front elevation view of a first embodiment of a form for a concrete footing according to the present invention.

FIG. 1 of the drawings provides a front elevation view of a first embodiment of a form for a concrete footing, designated generally as 10 in the drawings. The form 10 includes a square or rectangular box-shaped housing 12 formed by four walls, the housing 12 being open at both ends, so that the form 10 comprises a generally tubular configuration. It will be understood, however, that the housing 12 may be cylindrical or pyramidal, if desired, or may have any other suitable shape. The housing 12 may be made from any suitable material, such as cardboard, concrete, or plastic, including polyethylene, polypropylene, or other suitable material.

Horizontal support members 16 extend through the housing 12, both from front-to-back and from side-to-side. The front-to-back support members 16 may be parallel to each other and lie in a plane elevated above the side-to-side support members 16, which may be parallel to each other but extend in a direction normal to the front-to-back horizontal support members 16. The horizontal support members 16 may be rebar of the type commonly used for reinforcing concrete. A plurality of tube members 14 extend vertically from top-to-bottom through the tubular interior of the housing 12, and are hollow to facilitate soil sampling once the concrete footing is in place in the excavation. The tube members 14 may be joined to the upper and lower horizontal support members 16 in any conventional manner (welding, ties, etc.), and may extend above and below the box-shaped housing 12.

Figure 2:
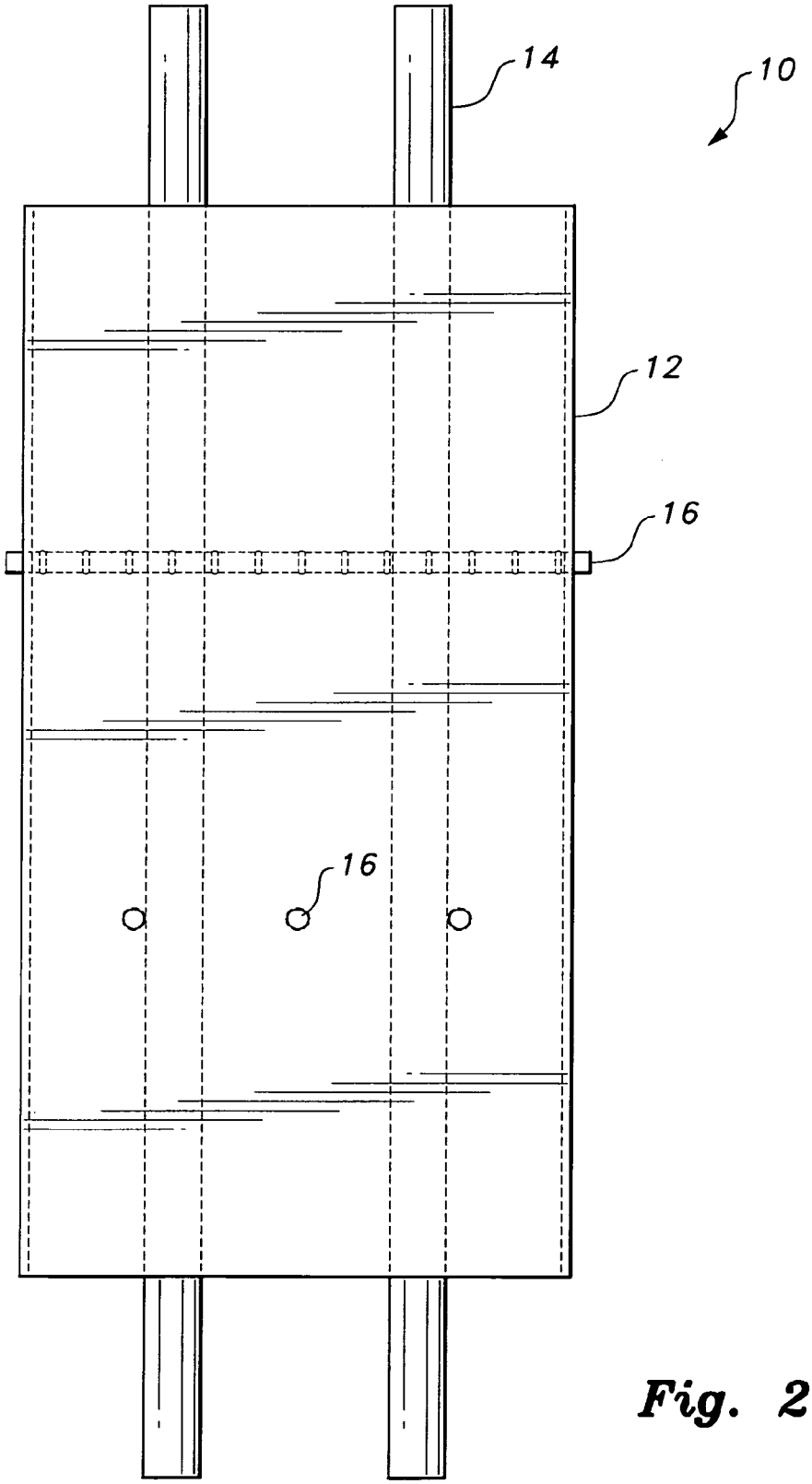
FIG. 2 is a side elevation view of the form of FIG. 1.
Figure 3:
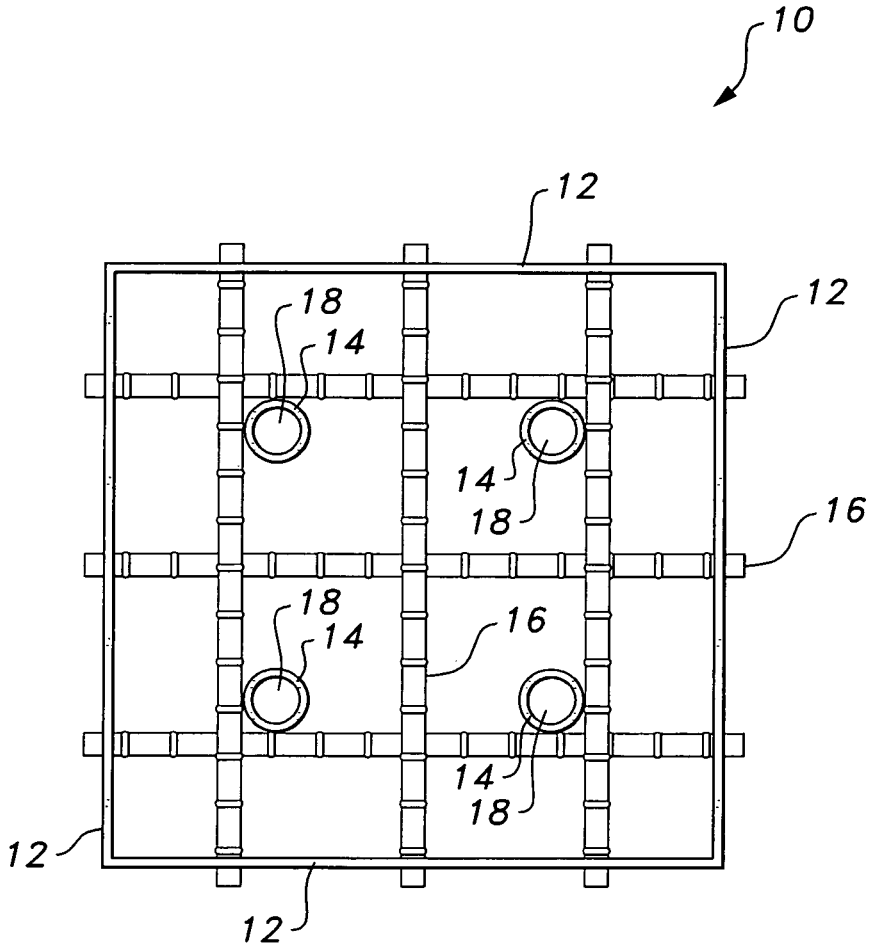
FIG. 3 is a top plan view of the form of FIGS. 1 and 2.

FIG. 2 is a side elevation view of the form 10, showing the horizontal support members 16 extending through the walls at the front and side of the housing 12. In this configuration, when the horizontal support members are made from rebar, it is desirable that the portions of the horizontal support members 16 that extend external to the housing 12 be capped or coated with a corrosion-resistant material in order to prevent corrosion of the support members 16 from exposure to moisture, acids, bases, or other corrosive materials in the soil over time, which might ultimately result in failure of the footing. FIG. 3 is a top plan view of the form 10 showing the horizontal support members 16 forming a rectangular grid or lattice pattern when viewed from above, the vertical tubes 14 being positioned at interior angles of the grid in order to be joined to both the front-to-back and side-to-side horizontal support members 16. FIG. 3 shows three front-to-back and three side-to-side support members 16, although the number of support members 16 may vary, depending upon the dimensions of the housing 12. The vertical tubes 14 are hollow, defining a channel or passage 18 to allow a soil sample to be taken of the subsoil after the concrete has been poured and the footing is in place in the excavation. The vertical tubes 14 may be welded or otherwise affixed to the support members 16.

Figure 4:
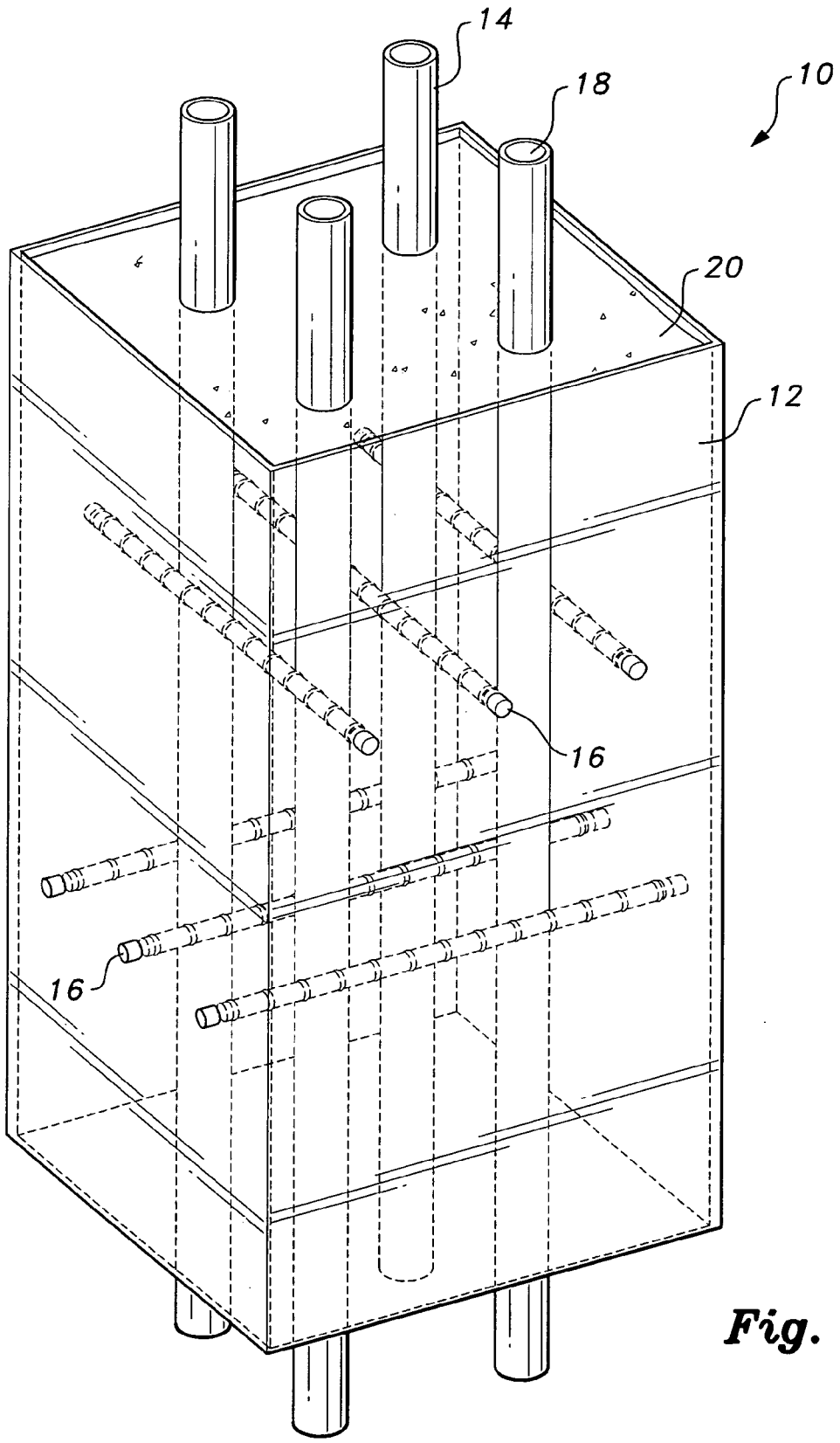
FIG. 4 is a perspective view of a footing formed using the form of FIGS. 1 through 3.

FIG. 4 is a perspective view of a footing formed using the form 10 for a concrete footing, showing the configuration of the support members 16 and the soil sampling or testing tubes or pipes 14 within the footing. FIG. 4 shows the form 12 filled with a mass of concrete 20, and the open channels or passages 18 in the tubes that facilitate sampling of the subsoil through the concrete mass 20. The form 10 can be configured in various sizes and shapes to accommodate different types of construction and load-bearing limits that may be required by local building code. It should be noted that while the terms "front elevation," "side elevation," top plan," "vertical," etc., have been used to describe the orientation of the footing system 10 and its various members or components, the intent is merely to show and describe the mutually orthographic disposition of the various rebar members 16 and soil sampling tubes 18 in the embodiment of FIGS. 1 through 4. It will be recognized that the form 10 of FIGS. 1 through 4 may be used to form concrete footings in slopes and similar sites wherein the soil sampling tubes 18 are oriented other than vertically.

In use, a hole is dug in the soil to a suitable depth for the footing, and the concrete footing system 10 is placed in the hole. Concrete 20 is poured into the form 12, taking care not to fill the soil sampling tubes 14 with the concrete. The open upper ends of the tubes 14 may be capped or otherwise closed until the need for a soil sample arises. The concrete 20 is allowed to set, leaving the form 12 in place to become an integral part of the footing, or, if the form 12 is made from a biodegradable material, at least leaving the tubes 14 and rebar members 16 set in the concrete footing 20. Soil testing devices may be inserted through the passages or channels 18 defined by the tubes 14 to test the subsoil of the foundation, even after the concrete within the form 12 has been poured and set.

Figure 5:
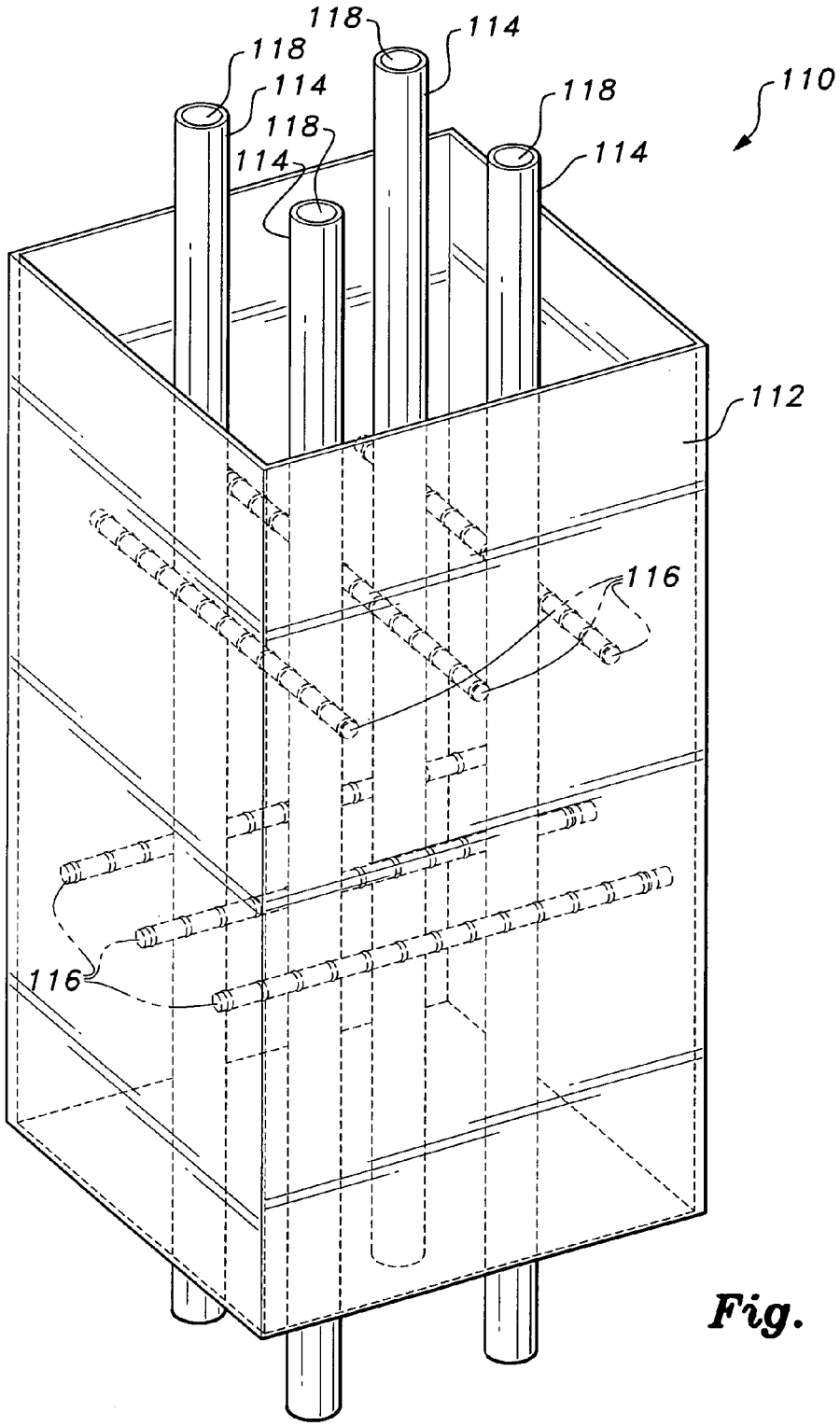
FIG. 5 is a perspective view of an alternative embodiment of a form for a concrete footing according to the present invention.
Figure 6:
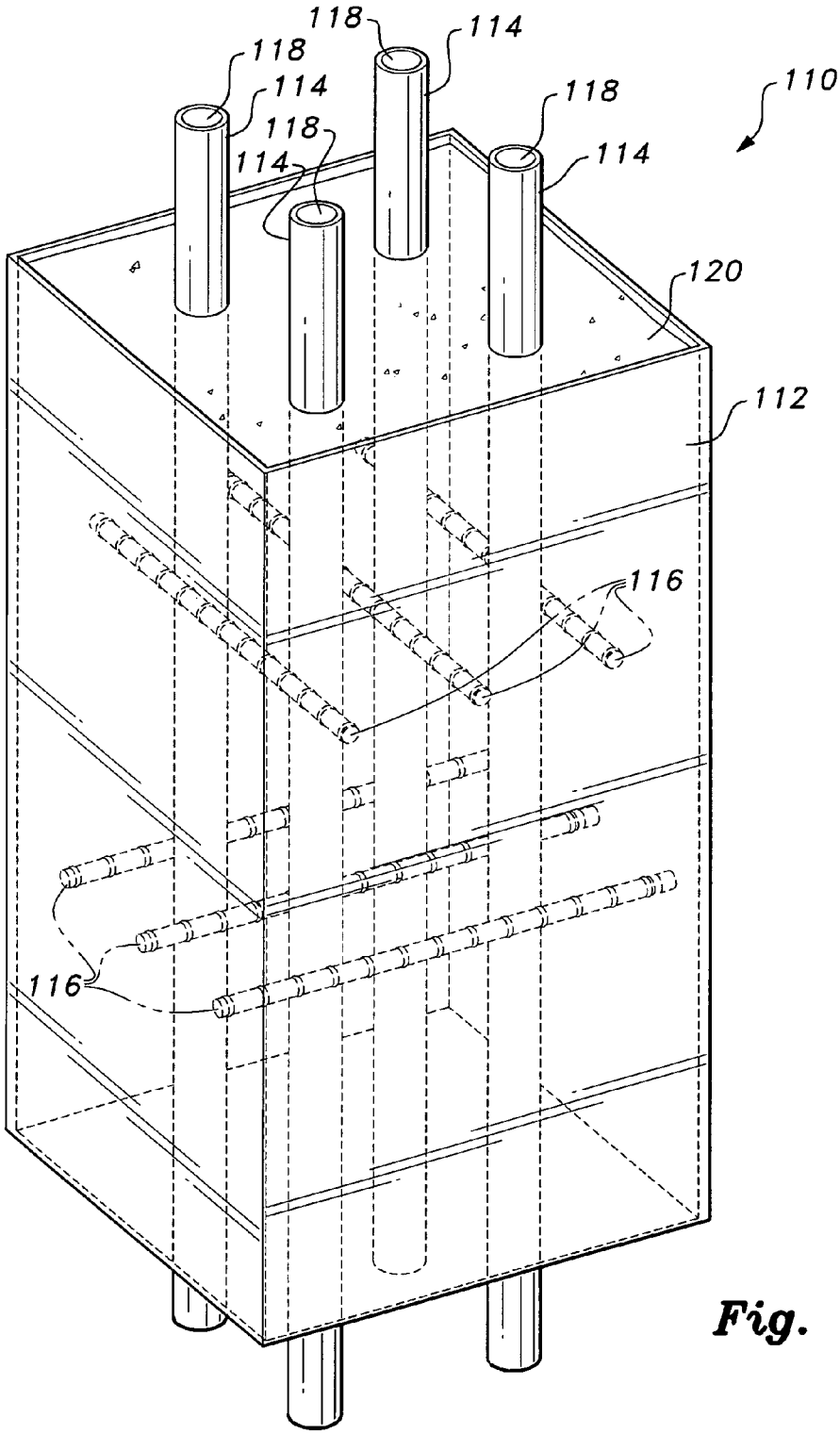
FIG. 6 is a perspective view of a footing formed using the form of FIG. 5.

FIGS. 5 and 6 are illustrations of a slightly modified alternative embodiment of the footing 10 of FIGS. 1 through 4. It will be noted that the housing 112 of FIGS. 5 and 6 is devoid of passages through the walls thereof, and thus the rebar or horizontal support members 116 cannot extend through the wall of the housing 112. The support members 116 are somewhat shorter, and their ends may be spaced somewhat inwardly from the inner surface of the wall of the form 112, or be supported by ledges formed on the inner face(s) of the walls of the housing 112. This allows the concrete 120 (FIG. 6) to flow completely around and over the ends of the support members 116, thus completely encapsulating the ends of the support members 116 within the concrete mass 120. This protects the ends of the rebar members 116 from corrosion due to contact with moisture and chemicals in the soil surrounding the form 110, thus retaining the strength provided by the horizontal support members 116 and preventing their deterioration.

This is important even where the form 112 is made of plastic, as water with various chemicals suspended or dissolved therein can still seep between the cured concrete mass 120 and the housing 112 to contact the ends of the support members 116 should they contact the inner surfaces of the housing 112, or be too closely spaced therefrom. By cutting the support members 116 to lengths somewhat shorter than the span between the walls of the form 112, the support member ends are completely encapsulated and protected within the concrete 120. Of course, the complete encapsulation and protection of the support members 116 is even more beneficial where the housing 112 is made from degradable materials, such as cardboard. The form of FIGS. 5 and 6 also includes the soil sampling or testing pipes or tubes 114 with their soil sampling passages 118 extending therethrough, from the open top or first end to extend from the opposite open bottom or second end.

Although FIGS. 5 and 6 show an upper plane of three rebars 116 extending from front-to-back and a lower plane of three rebars 116 extending from side-to-side, the horizontal support members 116 may comprise an upper rectangular frame of four rebars closely adjacent the walls at the top of the housing 112 and a lower rectangular frame of four rebars closely adjacent the walls at the bottom of the housing 112, if desired.

Figure 7:
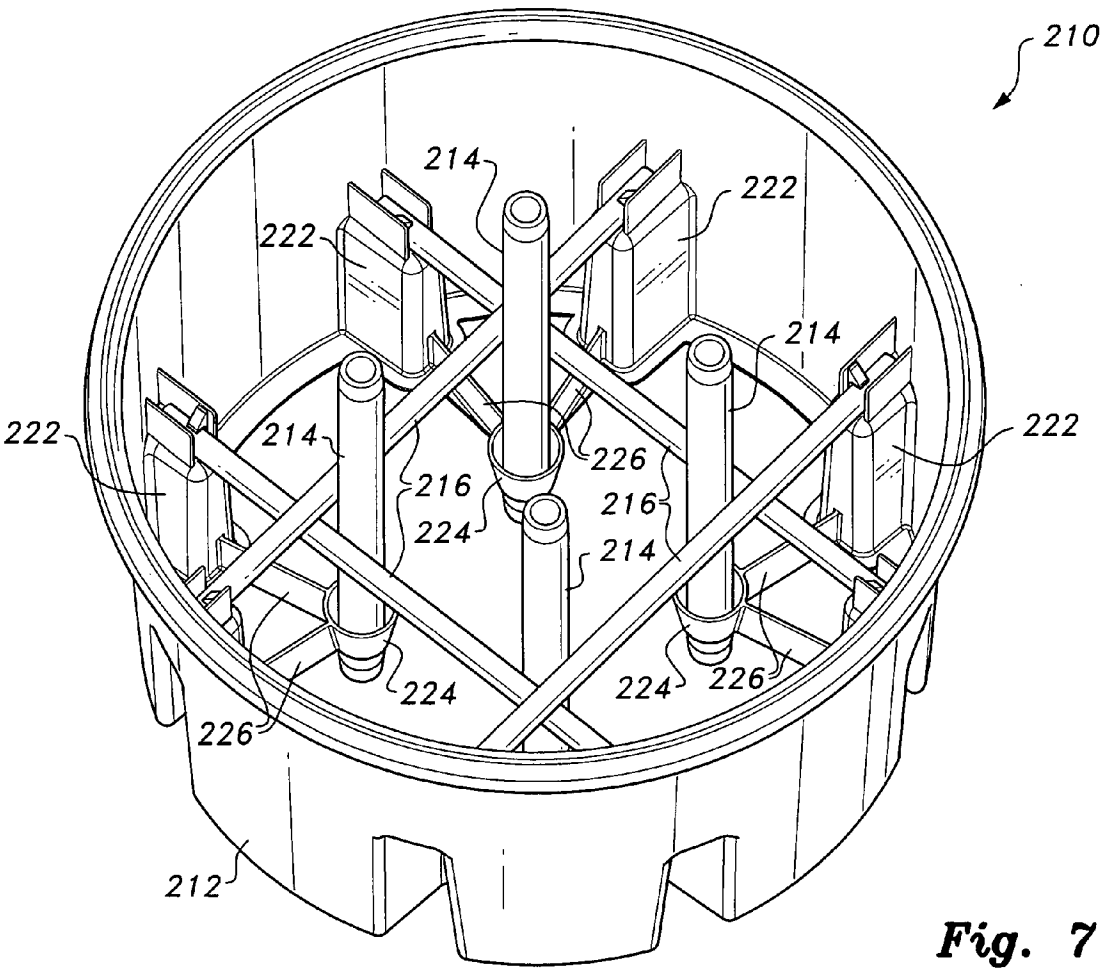
FIG. 7 is a perspective view of another alternative embodiment of a footing for a concrete form according to the present invention.

FIG. 7 provides an illustration of another alternative embodiment of a form for a concrete footing, designated generally as 210. The concrete footing system 210 includes a relatively shallow, circular mold or housing 212, the outer wall of the form 210 surrounding a substantially open core. The opposite first and second ends are open, as in the case of the other mold or form configurations 10 and 110 of FIGS. 1 through 6.

The housing 212 includes bosses or lugs 222 extending internally into the open central volume or core of the housing 212. These bosses or lugs 222 serve to support and attach the grid of rebar or horizontal support members 216 installed within the housing 212. In addition, support collars 224 for holding the soil sampling tubes or pipes 214 in place within the housing 212 are provided. The pipe support collars 224 may be made to have an internal diameter fitting closely about the sample tubes 214 to prevent the tubes from slipping, and/or the tubes may be conventionally welded or tied to the rebar members 216 to hold them in place. The pipe support collars 224 are attached to the mold or form 210 by a series of struts or arms 226 extending from the rebar support bosses 222. The various rebar support bosses 222 and pipe support collars 224 are disposed to hold the rebar 216 and soil sampling tubes 214 in an orthogonal array, generally as shown in FIG. 7 and in the other forms 12 and 112 of FIGS. 1 through 6.

Figure 8:
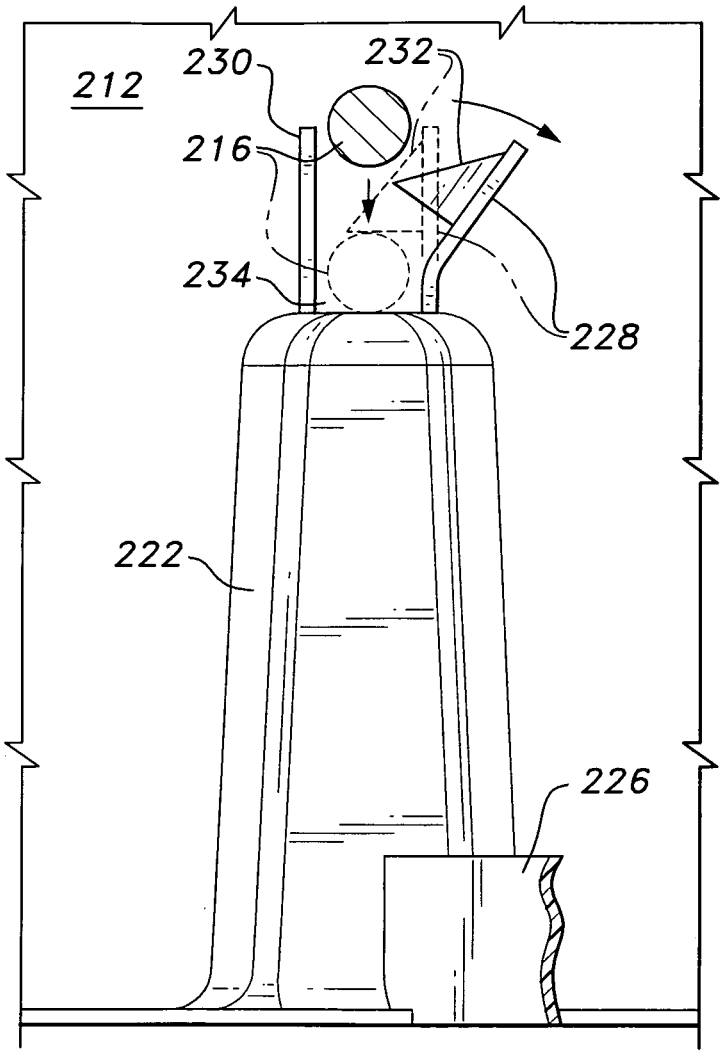
FIG. 8 is a partial elevation view of the form of FIG. 7, shown from inside the form with parts broken away and partially in section, showing further details of one of the rebar retaining clips.

Further details of the means for affixing the rebar members 216 within the housing 212 are shown in FIG. 8. Each rebar support boss 222 includes at least one flexible flange 228 at the upper end thereof, and an opposite flange 230 (flexible or inflexible), defining a slot therebetween. The first flexible flange 228 includes a rebar catch or finger 232 extending inwardly therefrom, toward the opposite second flange 230. The top of the rebar support boss 222, the two flanges 228 and 230, and the rebar catch or finger 232 define a rebar retention passage 234 therebetween. The rebar catch 232 preferably has an angled or sloped outer edge, allowing the rebar member 216 to be pushed downwardly into the slot and rebar retention passage 234 between the two flanges 228 and 230 while pushing the catch 232 and its flange 228 out of the way. The flexible flange 228 then snaps back into place, closing the finger or catch 232 over the end of the rebar member 216 to capture and secure the rebar in place.

As in the case of the second embodiment of FIGS. 5 and 6, the outer wall of the mold or housing 212 is devoid of openings therein (the inset rebar support bosses 222 are molded into the sidewall of the form 210 and define pockets therein, but are closed to the outside of the form). The rebar members 216 are cut to length to fit across the interior of the housing 212 and rest within two opposed retaining passages 234 without penetrating the outer wall of the form 210.

It should also be understood that while the mold or housing 212 of FIG. 7 is shown as having a low, cylindrical configuration, it may be manufactured to have any practicable shape as required for the desired application or footing installation. Moreover, the outer wall(s) of any of the forms or molds need not be parallel, as shown throughout the drawings. For example, the bases of the forms may be wider than their upper portions, either by making the forms in a pyramidal or frustoconical shape or by providing a base portion having a wider dimension(s) than the upper portion of the form.

The various rebar members 216 and soil sampling pipes or tubes 214 are installed within the mold or housing 212 at a central location of manufacture or assembly, and then shipped to the construction site as a prefabricated unit. The prefabricated form 210 is then placed in an excavation dug for the footing, and the form 210 is filled with concrete that is allowed to set or harden. The form remains in the excavation, which is then filled to grade or as required. Soil inspection is easily accomplished after the footing has been formed, by dropping a soil sampling or testing device through the sampling pipe(s) or tube(s) to access the soil beneath the footing. (The soil sampling tubes may be capped during the construction of the footing to preclude entry of foreign matter into the tubes.) Thus, construction may proceed at a steady pace without delay for soil site inspections, with the concrete footing system allowing the inspector to check the soil sample beneath the footing as construction work proceeds and after the footing has been poured.

Figure 9:
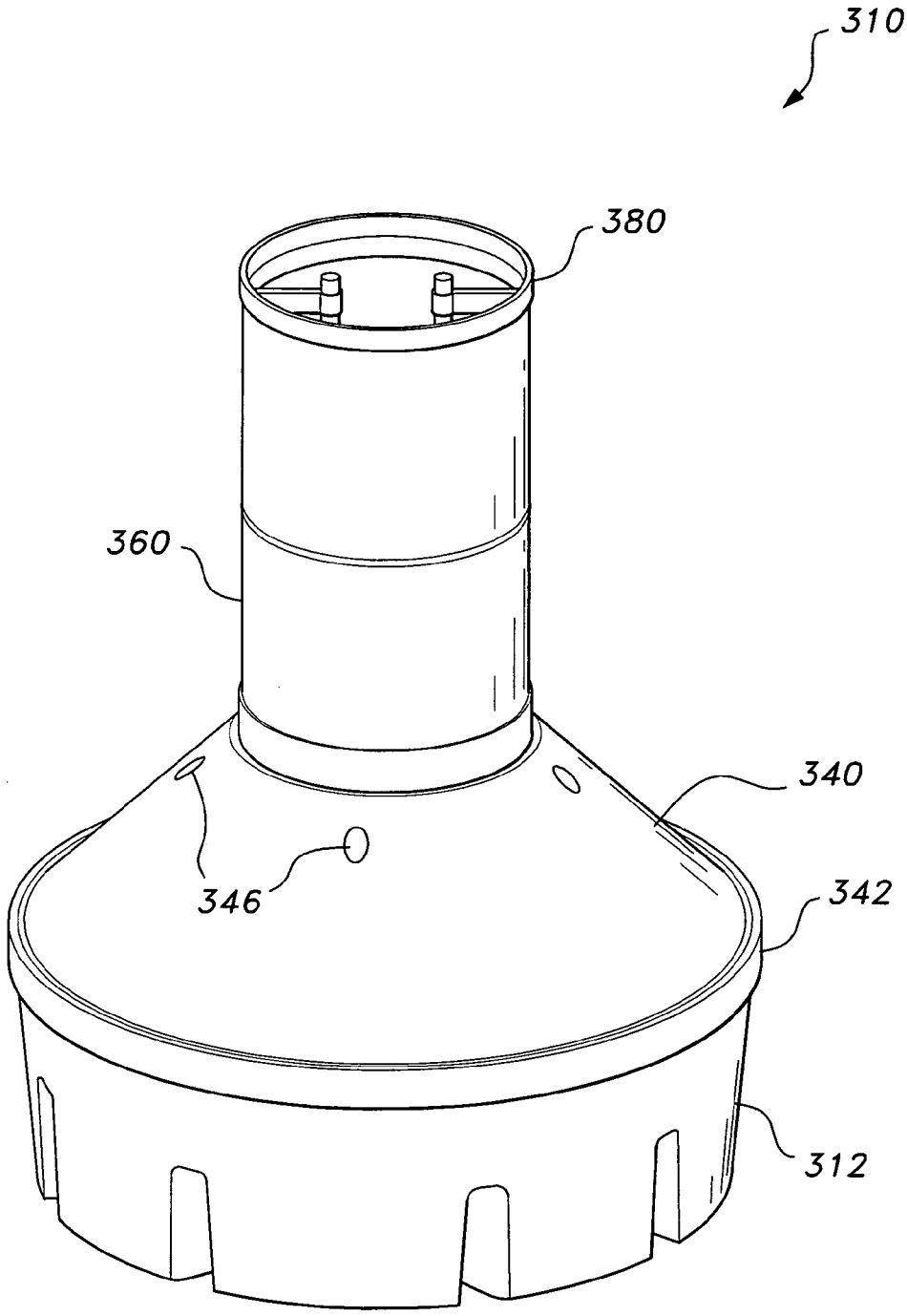
FIG. 9 is a perspective view of a further alternative embodiment of a form for a concrete footing according to the present invention.

FIG. 9 provides an illustration of yet another alternative embodiment of a form for a concrete footing, designated generally as 310. The concrete footing system or form 310 includes a relatively shallow, circular mold or housing 312 forming the base of the overall configuration, a frustoconical hood or cap 340 disposed atop the housing 312, a stackable tower case, column or chimney 360 disposed atop the frustoconical cap 340 and a tower mounting collar 380 that completes the configuration of the concrete footing system 310. The outer wall of the form 310 surrounds a substantially open core. The opposite first and second ends are open. This configuration is well suited for an environment in which the frost line or zone is relatively thick or where suitable foundation geography is located relatively deep in the earth. Thus, the form 310 would be laid so that the base housing 312 and/or cap 40 is/are installed on or within the foundation soil or bedrock. The tower 360 extends upwardly to the foundation line of the building.

Figure 10:
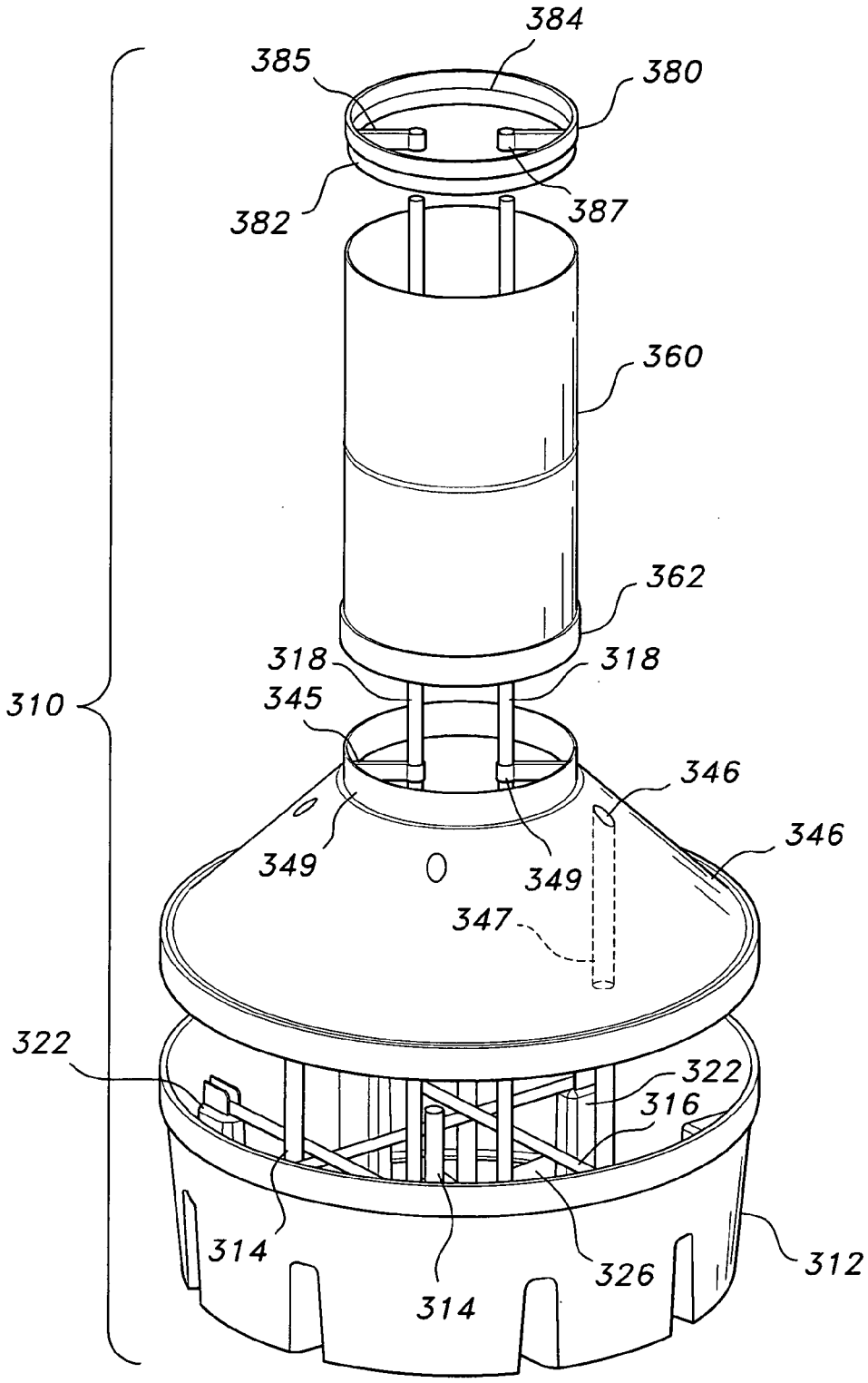
FIG. 10 is an exploded view of the form of FIG. 9.

As shown in FIGS. 9 and 10, the circular housing or base 312 is configured substantially the same as the housing 212 in FIG. 7. The interior of the housing 312 includes bosses or lugs 322 extending internally into the open central volume or core of the housing 312. These bosses or lugs 322 serve to support and attach the grid of rebar or horizontal support members 316 installed within the housing 312. As with housing 212, the housing 312 includes support collars, as in FIG. 7, for holding soil sampling tubes or pipes 314 in place within the housing 312. The pipe support collars for the concrete footing system 310 may be made to have an internal diameter fitting closely about the sample tubes 314 to prevent the tubes from slipping, and/or the tubes may be conventionally welded or tied to the rebar members 316 to hold them in place. The pipe support collars are attached to the mold or form 310 by a series of struts or arms 326 extending from the rebar support bosses 322. The various rebar support bosses 322 and pipe support collars are disposed to hold the rebar 316 and soil sampling tubes 314 in an orthogonal array, generally as shown in FIG. 7 and in the other forms 12 and 112 of FIGS. 1 through 6.

Figure 12:
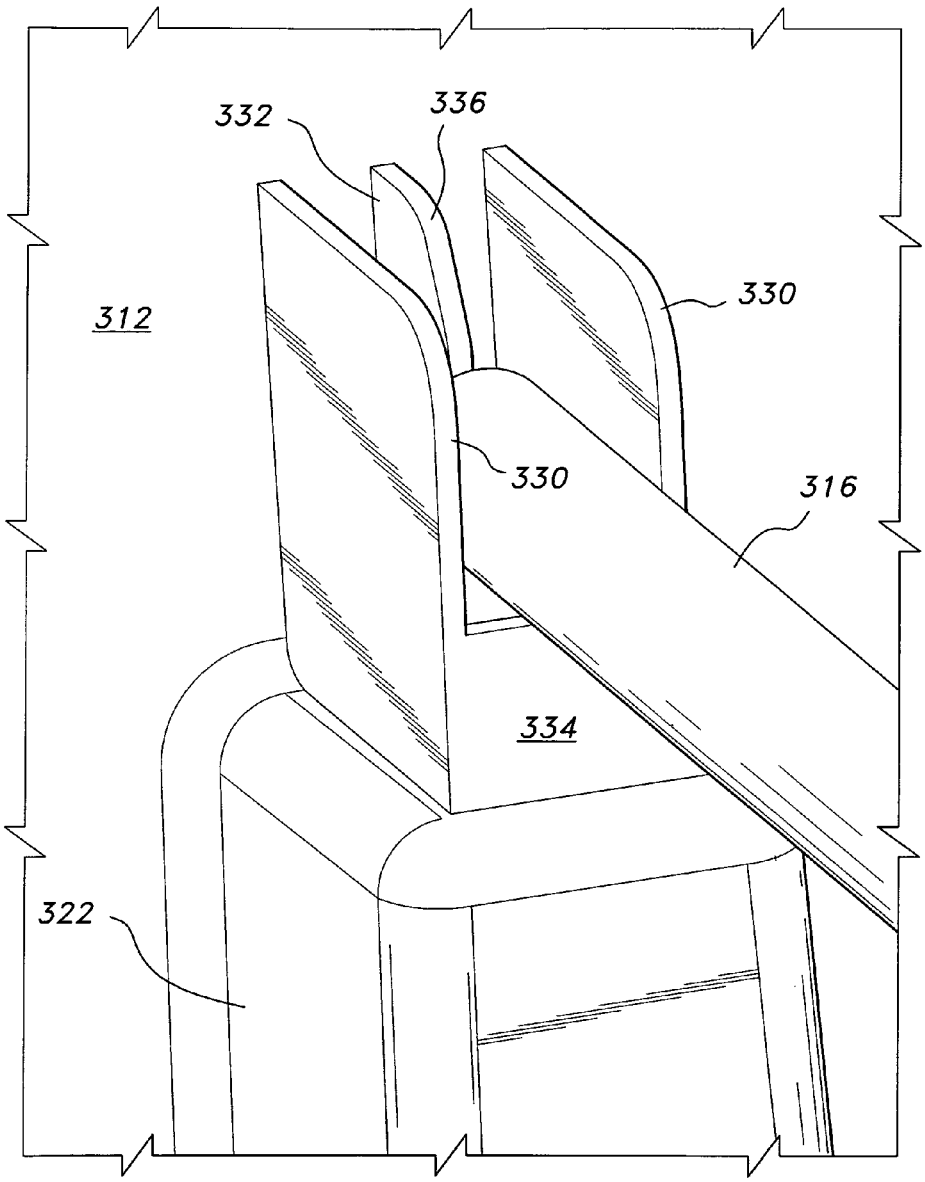
FIG. 12 is an enlarged, partial perspective view of a rebar pocket of the form of FIG. 9.

In this embodiment, the rebar support boss 322 includes features for easy and accurate installation of the rebar members 316. As shown in FIG. 12, each rebar support boss 322 includes two upstanding, spaced outer flanges 330 interconnected to a base panel 334 atop the rebar support boss 322. The outer flanges 330 and the base panel 334 together form a rebar pocket dimensioned to fit one end of a standard sized rebar member 316. An intermediate spacing flange 332 is formed between the outer flanges 330 to properly space the rebar member 316 away from the interior wall of the housing 312. The spacing ensures that the rebar members 316 will be completely encased in concrete when the footing is made and thereby avoid potential compromise to the structural integrity of the resultant footing due to corrosion of the rebar members 316. In other words, if the rebar members 316 within the resultant footing are exposed to the environment or surrounding soil, it increases the chance of corrosion from moisture, acids, bases, or other corrosive materials in the soil over time, which might ultimately result in failure of the footing. The spacing flange 332 extends from the interior of the base housing 312 to a predefined point and includes a downwardly angled slope 336 when seen in side profile. This slope 336 serves as a guide for installing the rebar member 316 properly into the rebar pocket. Thus, when a user lays the rebar members 316 into the base housing 312, the spacing flange 332 and the slope 336 permit the rebar member 316 to slide into proper place without additional measuring or manipulation.

As shown in FIGS. 9 and 10, the frustoconical hood or cap 340 is adapted to fit over the upper first end or rim of the base housing 312. Self-alignment means may be provided on the cap 340, housing 312, or both for easy and accurate installation of both parts. The cap 340 includes a large diameter outer ring 342 configured for slidable attachment to the housing 312. This attachment may be provided by, e.g., a simple sliding motion or snap fit between the parts. The outer surface of cap 340 slopes upwardly toward an inner, small diameter collar 344 adapted to fit inside tower case, column or chimney 360. A plurality of bar holding arms 345 extend interior of the inner collar 344. Each of arms 345 end with a bar holder 349, the purpose thereof explained in further detail below. A plurality of soil sampling holes 346 may be equidistantly distributed about the tower-receiving collar 344 to allow access to the soil beneath the footing. Preferably, each of the soil sampling holes 346 is formed by a hollow, sample tube or pipe 347 formed inside the cap 340 with each tube 347 aligned with a corresponding sample tube 314 inside the housing 312 and adapted to fit thereon. The cap 340 may also include vent holes to facilitate faster setting of concrete. The shape of the cap 340 permits even distribution of load forces to the more uniform base portion of the footing.

The tower case, column or chimney 360 may be a circular tube having a base mounting collar 362 disposed on the bottom, second end of the tower column 360. The base mounting collar 362 is dimensioned to fit over the inner collar 344 of the cap 340. The height of the tower column 360 is predetermined to the height necessary to overcome the freeze zone or thickness of soil not suitable for a foundation.

The tower mounting collar 380 disposed atop the tower column 360 includes an inner insert ring 382 adapted to slidably connect the collar 380 to the tower column 360. The diameter of the insert ring 382 is smaller than the outer diameter of the collar 380 resulting in forming a shelf 384 in the interior of the collar 380. The interior of the collar 380 may also include a plurality of bar holding arms 385 extending from the inner wall. Each of arms 385 end with a bar holder 387. To reinforce the structure of the resulting footing, vertical rebar members 318 may be inserted through the respective bar holders 387, 349 in the tower mounting collar 380 and inner collar 344. Alternatively, the vertical rebar members 318 may be replaced with long sample tubes extending toward the bottom of the concrete footing system 310. Although the depiction in FIGS. 9 and 10 show closed loop bar holders 349, 387, these holders may be configured as an open clip fastener, ratchet clip fasteners, or any other securing means for a bar member.

The concrete form 310 is a modular, reconfigurable unit, and the operational use thereof is the same as above with the previous embodiments. With the housing 312 serving as the main base, different configurations and numbers of caps 340, tower columns 360 and tower mounting collars 380 may be used, depending on the requirements of the building. For example, a plurality of tower columns 360 may be stacked on top of each other by using the tower mounting collar 380 between each tower column 360. The shelf 384 inside the collar 380 serves as a mounting base for a subsequent tower column 360. To aid assembling the towers and collars and ensure proper alignment therebetween, self alignment means may be provided on either one or all the components. The self alignment means may include alignment indicia on outer surfaces or key and mating keyway.

Figure 11:
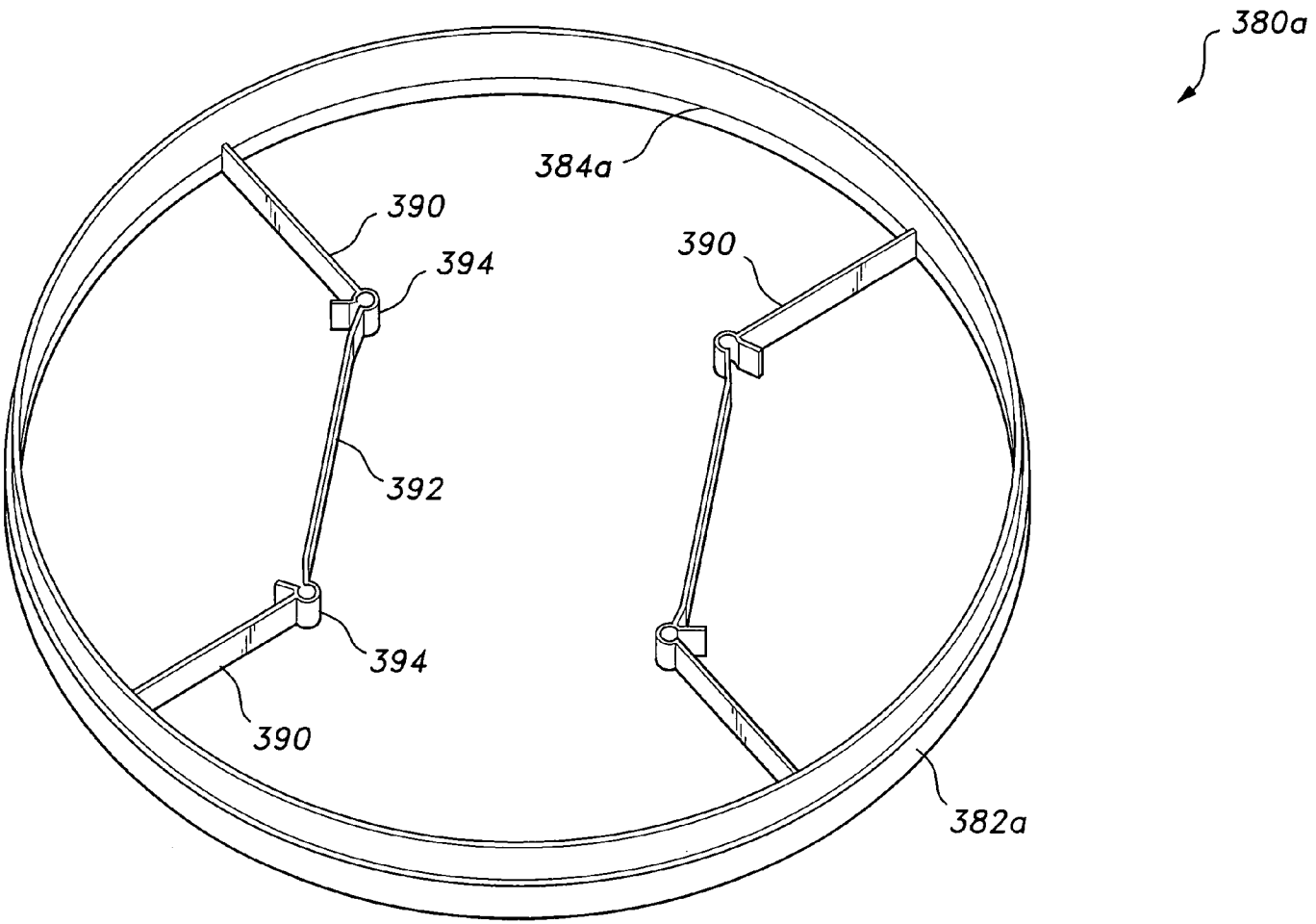
FIG. 11 is a perspective view of an alternative embodiment of a collar for the form of FIG. 9.

The tower mounting collar 380 is not limited to the configuration shown in FIGS. 9 and 10. For example, the tower mounting collar 380 may include more than two bar holders of alternative configuration. Referring to FIG. 11, the alternative tower mounting collar **380*a* includes an inner insert ring 382*a* adapted to slidably connect the collar 380*a* to a tower column. The diameter of the insert ring 382*a* is smaller than the outer diameter of the collar 380*a* resulting in forming a shelf 384*a* in the interior of the collar 380*a*. Two pairs of bar holders 394 are attached to the collar 380*a* by a series of bar holding struts or arms 390. Each pair of bar holders 394 is interconnected by a strut 392. Each bar holder 394 may be an open clip having an angled tab, which together with an adjacent angled portion of the strut 392, permits guided insertion of a vertical rebar or a sample tube. As with the previous embodiment, alternative bar fasteners may be used in lieu of the open clip bar holder 394**.

Figure 13:
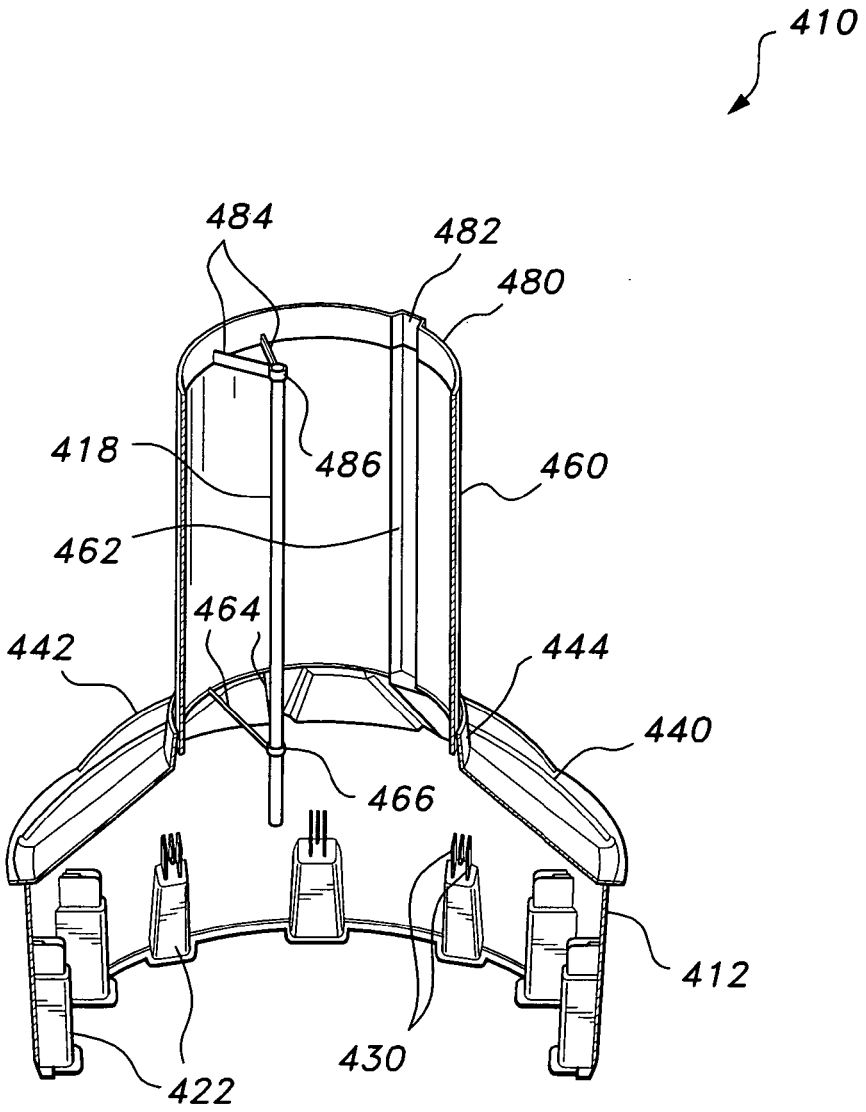
FIG. 13 is a perspective view in section of another embodiment of a form for a concrete footing according to the present invention.

Referring to FIG. 13, the alternative concrete form 410 illustrates a configuration where the frustoconical cap 440 does not include sample tubes formed therein. The concrete form 410 includes a relatively shallow, circular mold or housing 412 forming the base of the overall configuration, a frustoconical hood or cap 440 disposed atop the housing 412, a stackable tower case, column or chimney 460 disposed atop the frustoconical cap 440 and a tower mounting collar 480 that completes the configuration of the concrete footing system 410. The outer wall of the form 410 surrounds a substantially open core. The opposite first and second ends are open.

The housing 412 includes a plurality of bosses or lugs 422 extending internally into the open central volume or core of the housing 412, the bosses 422 serving to support and attach a grid of rebar or horizontal support members vis-à-vis outer flanges 430. The frustoconical hood or cap 440 is adapted to fit over the upper first end or rim of the base housing 412. The outer surface of cap 440 slopes upwardly toward an inner, small diameter collar 444 adapted to receive the tower column 460. Formed reinforcing ribbing 442 may be provided on the surface to increase strength of the footing. The tower column 460 may be a substantially circular tube dimensioned to fit inside the inner collar 444. An alignment groove 462 is formed along the length of the tower column 460 to facilitate easy installment of the column 460 relative to the inner collar 444 and the tower mounting collar 480. The lower portion of the tower column 460 includes at least one bar holder 466 attached to the interior of the tower column 460 by a series of struts or arms 464. The tower mounting collar 480 includes an alignment groove 482 aligned with the alignment groove 462. At least one bar holder 486 is attached to the interior of the tower mounting collar 480 by a series of struts or arms 484. When assembled, the respective bar holders 466, 486 are aligned to hold either a vertical rebar 418 or a sampling tube. As with the previous embodiments, alternative bar fasteners may be used in lieu of the closed loop depicted in FIG. 13.

Figure 14:
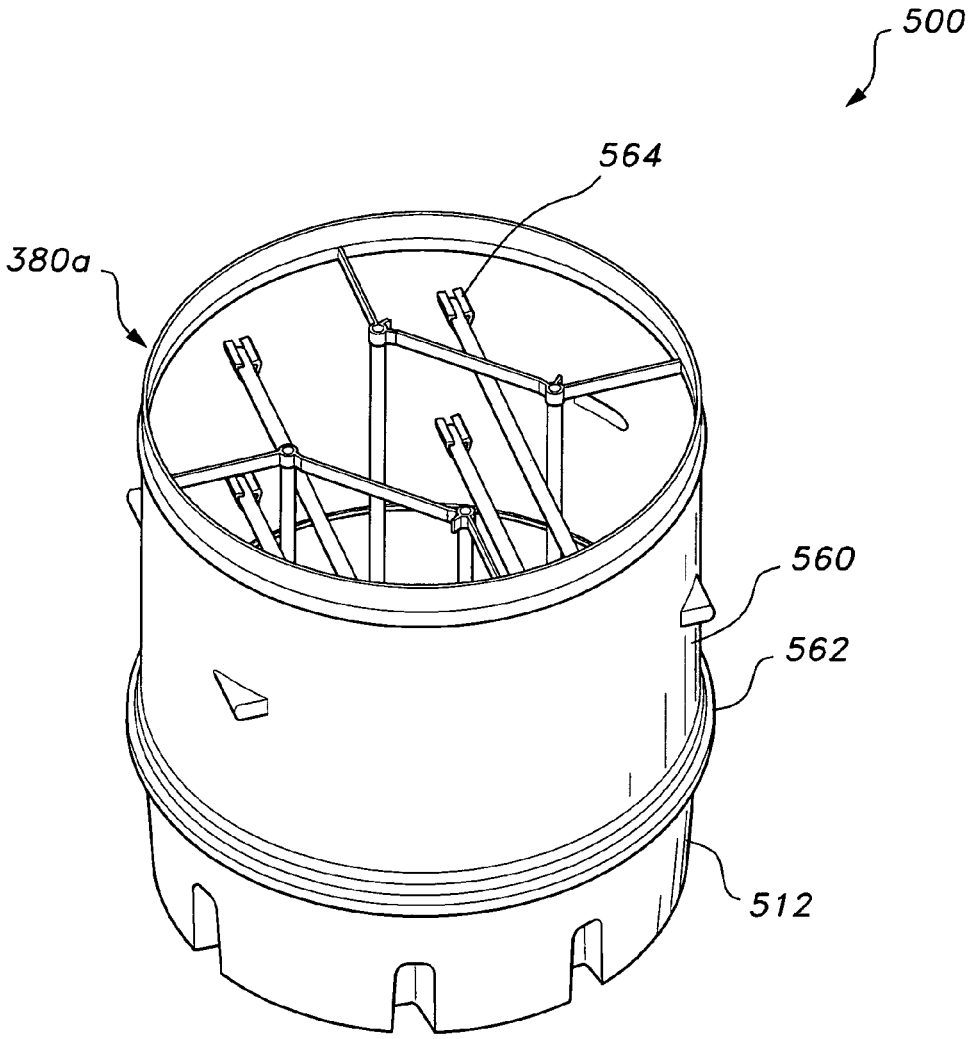
FIG. 14 is a perspective view of a still further embodiment of a form for a concrete footing according to the present invention.

Referring to FIG. 14, the alternative concrete form 500 illustrates a configuration for handling substantial heavy loads. The concrete form 500 includes a relatively shallow, circular mold or housing 512 forming the base of the overall configuration, a stackable tower case, column or chimney 560 disposed atop the base housing 512 and a tower mounting collar 380*a* that completes the configuration of the concrete footing system 500. The outer wall of the form 500 surrounds a substantially open core. The opposite first and second ends are open.

In this embodiment, both the base housing 512 and the tower mounting collar 380 are substantially similar to the previous embodiments, and no further details will be discussed.

Turning to the tower column 560, the tower column 560 is a relatively large diameter cylinder with dimensions matching that of the base housing 512 and mounted thereon by a mounting rim 562. A plurality of horizontal bar holding clips 564 are disposed in the interior of the tower column 560 to hold an array of rebar members at near both the top and bottom of the tower column 560. The robust size of the resulting concrete form 500 makes it ideal for larger buildings. As an alternative, the tower column 560 may include a knock-out hole for installation of PVC piping and wires.

It is to be understood that the above embodiments may encompass a variety of alternatives. For example, the base housing, tower collar and the tower mount collar may all be formed with a hinge and secured by a latching system for easy assembly and disassembly. The parts may all be molded or made by various materials such as wood, plastic, metal or combination thereof. In addition, the dimensions may also be varied depending on the demands of the task.

It will also be understood that, although the drawings show the grid or lattice of horizontal support members or rebars shown in two planes, the scope of the invention as claimed also extends to a grid or lattice of coplanar front-to-back and side-to-side rebars or horizontal support members. Further, although the grid or lattice is preferably rectangular, the scope of the invention as claimed extends to a grid or lattice of horizontal support members joined at angles that may be greater or less than 90°. Although the vertical tubes are shown substantially orthogonal to the grid or lattice of rebars or horizontal support members, the vertical tubes may be joined to the grid of horizontal support members at angles that may be greater or less than 90°.

The scope of the invention as claimed also extends to a form in which the housing or outer wall is omitted, the form comprising the grid or lattice of rebars or horizontal support members having the vertical tubes permanently or removably attached thereto. Such a form would be placed in an excavation with the grid of horizontal support members extending across opposing walls of the excavation to support the tubes in an upright position, the footing being formed by pouring concrete into the excavation, but leaving the vertical tubes open at the top and bottom of the footing for removing soil samples.

Finally, the scope of the invention also extends to a concrete footing having a soil sample tube extending through the body of the footing from top to bottom.

It is to be understood that the present invention is not limited to the embodiments described above, but encompasses any and all embodiments within the scope of the following claims.

We claim:

1. A form for a concrete footing, comprising:

a tubular housing for receiving concrete, the housing having an open top and bottom, a peripheral wall defining a hollow interior, the peripheral wall defining inner and outer surfaces;

a plurality of support bosses spaced about the inner surface, wherein the bosses define first and second coplanar groups located in respective first and second different planes;

a plurality of concrete reinforcement bars, wherein each of the reinforcement bars have opposing ends disposed within the peripheral wall and engaging the plurality of support bosses, the reinforcement bars being secured to one another and defining a lattice of horizontal support members thereby forming first and second coplanar groups of reinforcement bars located in respective first and second different planes.

2. The form for a concrete footing according to claim 1, further comprising at least one hollow soil sampling tube disposed through the lattice and secured thereto, the tube having mutually opposed open ends extending from the lattice.

3. The form for a concrete footing according to claim 2, wherein said soil sampling tube extending at least from the top to bottom of the peripheral wall.

4. The form for a concrete footing according to claim 3, wherein said lattice is formed by a grid of substantially orthogonal concrete reinforcement bars.

5. A form for a concrete footing, comprising:

a housing for receiving concrete, the housing having an open top and bottom, a substantially continuous peripheral wall defining a hollow interior, the peripheral wall defining inner and outer surfaces; and a plurality of support bosses spaced about the inner surface, each of the support bosses including plates forming a U-shaped slot adapted for receiving and supporting reinforcement bars, wherein the plurality of bosses define first and second coplanar groups located in respective first and second different planes.

6. The form for a concrete footing according to claim 5, wherein the plates are U-shaped spring clips.

7. The form for a concrete footing according to claim 5, further comprising a plurality of parallel, vertical soil sampling tube members extending through the hollow interior of the housing.

8. The form for a concrete footing according to claim 7, wherein the peripheral wall defines a cylindrical hollow form and frustoconical cap disposed atop the cylindrical form, the sampling tubes extending up through the frustoconical cap.

9. The form for a concrete footing according to claim 8, further comprising at least one tubular tower extending upward from said frustconical cap, said soil sampling tube extending upward through said at least one tubular tower.

10. The form for a concrete footing according to claim 9, further comprising a collar disposed atop said at least one tubular tower.

11. The form for a concrete footing according to claim 10, further comprising a plurality of support bars extending radially inward from said collar and at least one guide ring attached to said support bars, said at least one soil sampling tube extending through the at least one guide ring.

12. The form for a concrete footing according to claim 5, further comprising a plurality of reinforcement bars secured to one another and defining a lattice of horizontal support members, wherein the lattice is formed by a grid of substantially orthogonal reinforcement bars.

13. The form for a concrete footing according to claim 12, wherein the reinforcement bars are permanently secured to each other.

14. The form for a concrete footing according to claim 12, wherein the reinforcement bars are removably secured to each other.

15. The form for a concrete footing according to claim 12, further comprising at least one hollow soil sampling tube disposed through the lattice and secured thereto, the tube having mutually opposed open ends extending from the lattice.

16. The form for a concrete footing according to claim 7, wherein the peripheral wall defines a cylindrical hollow form and frustoconical cap disposed atop the cylindrical form, and a plurality of parallel, vertical reinforcement bars extending upward through the cylindrical hollow form.

* * * * *